United States Patent [19]

Bühler et al.

[11] 4,443,880

[45] Apr. 17, 1984

[54] LIQUID-COOLED COVER FOR ARC FURNACES

[75] Inventors: Karl Bühler, Nussbaumen; Karl Oldani, Baden, both of Switzerland

[73] Assignee: BBC Brown, Boveri & Company, Ltd., Baden, Switzerland

[21] Appl. No.: 460,301

[22] Filed: Jan. 24, 1983

[30] Foreign Application Priority Data

Jan. 29, 1982 [CH] Switzerland ..... 553/82

[51] Int. Cl.[3] ..... F27D 1/02; F27D 1/12

[52] U.S. Cl. ..... 373/74

[58] Field of Search ..... 373/73, 74, 75, 76; 266/280, 286; 432/248, 250; 110/336, 331, 332, 335

[56] References Cited

U.S. PATENT DOCUMENTS 3,429,973 2/1969 Carter et al. ..... 432/238 X
4,132,852 1/1979 Andoniev et al. ..... 373/74
4,273,949 6/1981 Fischer et al. ..... 373/74

FOREIGN PATENT DOCUMENTS 2048445 5/1980 United Kingdom ..... 373/74

*Primary Examiner*—Roy N. Envall, Jr.
*Attorney, Agent, or Firm*—Oblon, Fisher, Spivak, McClelland & Maier

[57] ABSTRACT

A liquid cooled cover for an electric furnace, wherein in order to lengthen the service life of the thermally highly stressed cover, cooling pipes are located essentially parallel and approximately vertically to the furnace tipping direction at a predetermined distance from each other. The cooling pipes are embedded in a fireproof construction material (57, 57') and constitute its reinforcement. The cooling liquid is supplied and removed exclusively via a cover ring, which is constructed as a cooling liquid distributing conduit in the periphery of the cover and which provided with integrated bypass openings. The composite construction of cooling pipes and fireproof construction material achieves a high thermal and mechanical stability of the furnace cover and the cooling system is largely removed from altering temperature stresses.

21 Claims, 10 Drawing Figures

FIG.5
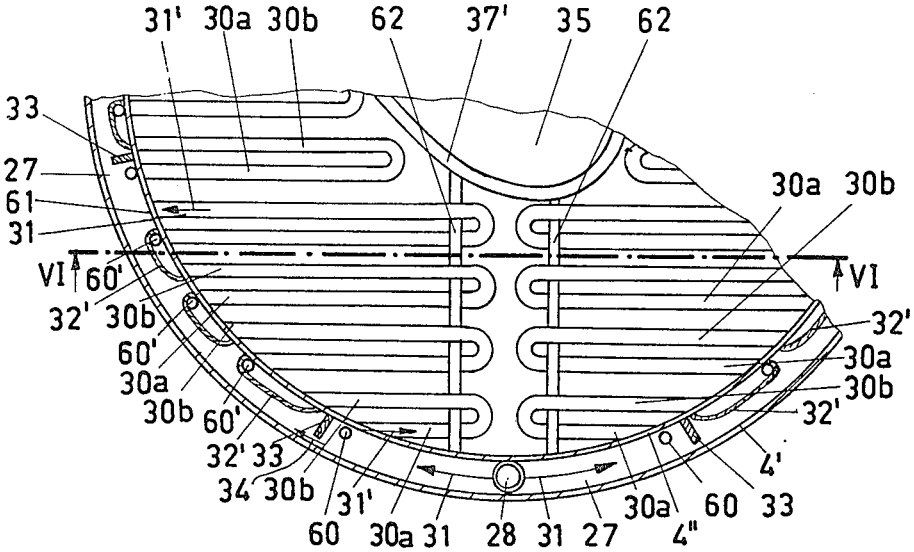
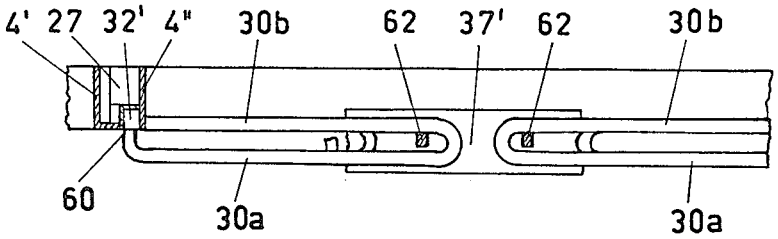
FIG.6

LIQUID-COOLED COVER FOR ARC FURNACES

BACKGROUND OF THE INVENTION

1. Field of the Invention

This invention relates to an electric furnace, particularly an arc furnace, with a liquid cooling device for thermally highly stressed construction parts of the furnace cover and with essentially horizontal cooling pipes which carry liquid and empty in a cooling liquid distributing conduit on a cover ring.

2. Description of the Prior Art

Such a liquid-cooled furnace cover is known from the publication Clesid; Croupe Creusot Loire; "Panneaux et Voutes Refroidis" [French-Cooled Panels and Vaults], undated. This cover consists of pipe bundles which are basically slightly arched, radially positioned parallel and adjacent to each other and extend from the central cover opening to the cover edge. The liquid is supplied through a ring line in the wall of the central cover opening and the liquid is removed through a ring line in the cover ring.

A protective layer of fireproof material which is comparatively thin compared to the thickness of a customary arc furnace cover consisting of fireproof construction material is applied to the part of the cooling pipes which faces the inside of the furnace. This protective layer both protects the cooling pipes from heat radiation and prevents too much heat from being removed from the furnace area.

It is possible to save fireproof material when such liquid-cooled furnace covers are used, but there is also the danger, given the relatively thin protective layers, that they can loosen at certain spots in an uncontrolled fashion, e.g. by mechanical action when the cover is raised or lowered, by thermal tensions inside the layers as a result of inhomogeneous heat radiation, unequal cooling action or when the furnace cover cools down. The heat transfer and thus the heat loss is particularly great at the exposed areas where the metal surface of the cooling pipes is directly irradiated by the arcs. Moreover, the non-protected areas of the cooling pipes receive a greater thermal stress then the other, protected part of the cooling pipes facing the inside of the furnace. The non-protected areas in the furnaces can become greatly heated by the smelting in two-shift or three shift operation which is normally continuous in steel plants and foundries, without being noticed by the personnel. In the most unfavorable instances, if, for example, the cooling conditions are unsatisfactory, these hot areas can lead to perforations which can entail severe consequences.

Detection systems for monitoring cooling systems are complicated and expensive. If there were an indication of trouble, the furnace cover would then have to be taken out of operation so that the defective areas could be repaired. In addition, cooling pipes which face the inside of the furnace and are covered only with a relatively thin protective layer are constantly exposed to forces of expansion and construction due to sharp variations of temperature, even though they are given a stress-free annealing before assembly. These forces exert thermal stresses on the cooling pipes which are transferred to the welding seams connecting the cooling pipes to the cover ring, and tears can form under constant stress which then result in a breakthrough of water. Moreover, the weight of a liquid-cooled cover which consists of lined-up cooling pipes is great, and special measures must be taken when it is transported and placed on the furnace vessel.

SUMMARY OF THE INVENTION

Accordingly, the objects of this invention are to provide a novel liquid-cooled furnace cover for electric furnaces, particularly for arc furnaces, which is simple to construct, economical to finish, with which a high useful life can be achieved and the construction of which practically eliminates instances of damage.

These and other objects are achieved by providing a novel liquid cooled furnace cover including cooling pipes which run essentially parallel to each other, approximately vertically to the tipping direction, are at a predetermined distance from each other, are embedded in the fireproof construction material of the cover and constitute its reinforcement; wherein the cooling liquid is supplied and removed exclusively via a cover ring, which is constructed as a cooling liquid distributing conduit.

This invention has the following advantages:

Cooling a qualitatively high-grade fireproof construction material reduces its wear and tear under high thermal stress, resulting in a high service life of the furnace cover.

The weight of the furnace cover can be considerably reduced.

Any vapor bubbles arising in the cooling pipes are immediately removed from them and pass into the distributing conduit, from which they can freely escape.

According to the invention one part of the cooling conduits empty directly into the distributing conduit and another part of the cooling conduits are interconnected to each other in one piece or by deflection means in the distributing conduit and hydraulically separated from the distributing conduit. The walls of the cover openings have several cooling chambers which are separated hydraulically from each other and into which another part of the cooling conduits empty, whereby successive cooling conduit pairs connected inside the distributing conduit by deflection chambers empty into successive cooling chambers of this cover openings. The has the advantage that as a result of the one-piece connection of the cooling pipes to each other or of the use of deflection chambers in the distributing conduit, the heat can be taken up and given off evenly by the cooling pipes, since the pipe connections are located in the distributing conduit and no thermal stresses can develop. This largely removes the cooling system from the effects of alternating temperature stresses.

According to the invention the liquid cooling device includes several hydraulically separated cooling circulatory systems. Each cooling circulatory system is formed by several series-connected parallel cooling conduit pairs, and the cooling liquid entrance and exit openings of all cooling circulatory system empty into the cover ring constructed as a distributing conduit. Bypass openings are provided between the cooling liquid entrance and exit openings of each cooling circulatory system in the cover ring constructed as a distributing conduit. This has the advantage that the cooling occurs evenly over the entire surface of the furnace cover, and that the cooling liquid in the distributing conduit which passes through the cooling conduits and is heated thereby is cooled by the relatively cold cooling liquid which enters directly through the bypass openings in the distributing conduit.

According to a further embodiment of the invention the cooling pipes are constructed in inner and outer layers, where in the inner layer cooling pipes face the inside of the vessel and are constructed in one piece, and the one end of one part of the cooling pipes empties with their cooling liquid entrance openings directly into the distributing conduit and the other part of the one end of the cooling pipes empties into deflection means located inside the distributing conduit and is hydraulically separated from the distributing conduit, and the other end of the cooling pipes is U-shaped and connects up with the outer layer of the cooling pipes. One part of the outer layer of cooling pipes empties directly into the distributing conduit with the liquid exit openings and the other part of the outer layer of cooling pipes empties in deflection chambers located inside the distributing conduit and is hydraulically separated from the distributing conduit. Due to the one-piece construction and the rounded ends of the inner layer cooling pipes, the heat is evenly received and given off by the cooling pipes. Since there are no edges and corners or material connections in the cooling pipe layer facing the inside of the vessel, no thermal stresses can develop and the cooling system is largely removed from the effects of alternating temperature stresses.

Further according to the invention the deflection means are formed by chambers in the distributing conduit which guide the cooling liquid of two adjacent cooling pipes of a cooling circulatory system and hydraulically separate it from the cooling liquid in the distributing conduit. This arrangement allows the cooling pipes to be connected in a simple manner.

Additionally the spacing of the oppositely adjacent cooling pipes is approximately twice as great as their outer diameter. This keeps the weight of the composite construction of cooling pipes and fireproof construction material low while assuring an optimum cooling of the fireproof construction material and sufficient strength of the carrying construction for the fireproof construction material.

Furthermore the fireproof construction material can be set as a prefabricated construction unit into the cooling system of the furnace cover. This makes possible an economical manufacture of the furnace cover.

According to the invention the prefabricated construction units are permanently connected to each other mechanically by a fireproof binding agent, e.g. silicon rubber. The construction units can be simply and securely connected by these measures.

According to the invention dilatation spaces are provided between the cooling pipes and the surrounding fireproof construction material. The dilation spaces are filled with a fireproof compressible means, e.g. silicon rubber. This has the advantage that as a result of the dilation spaces, which are filled with silicon rubber, for example, the fireproof construction material can expand in an unimpeded manner without deforming forces being exerted on the cooling pipes.

According to the invention the bypass opening(s) in the distributing conduit is (are) dimensioned so that, taking into consideration the hydraulic resistance of the associated cooling conduits, a predeterminable amount of cooling liquid flows through the bypass opening(s) which is smaller than the amount which flows through the associated cooling conduits. Alternatively, the bypass opening(s) in the distributing conduit is (are) dimensioned so that, taking into consideration the hydraulic resistance of the associated cooling conduits, a predeterminable amount of cooling liquid flows through the bypass opening(s) which is just as great or greater than the amount which flows through the associated cooling conduits. This has the advantage that the rate of flow, flow speed, etc. of the cooling liquid which is introduced into the cooling conduits and the cooling conduits themselves can be dimensioned so that if part of the cooling liquid vaporizes in the cooling conduits, the vapor is immediately removed from the cooling system through the associated bypass opening(s) of every associated cooling circulatory system in the cooling liquid distribution chamber without the occurrence of an interaction between the cooling liquid and the vapor, which would be disadvantageous for the cooling action. A combined liquid-vapor cooling is obtained in this manner, in contrast to the classic liquid cooling, whereby the heat required for vaporization is removed from the construction parts to be cooled and is thus made useful for cooling. The flow speed of the cooling liquid in the cooling pipes is measured so that no vapor bubbles can settle in the cooling pipes, but rather they are carried away with the cooling liquid and transported into the distributing conduit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5 is a cutaway portion of a schematic top view partially in cross-section, of a second embodiment of the furnace cover of the invention provided with two layers of the cooling pipes;

FIG. 6 is a vertical cross-sectional view through the furnace cover of FIG. 5;

FIG. 9 is a vertical cross-sectional view through the cooling pipes and the construction units of fireproof construction material.

FIG. 10 is a vertical cross-sectional view through another embodiment of the cooling pipes and the construction units of fireproof construction material.

DESCRIPTION OF THE PREFERRED EMBODIMENTS

Figure 1:
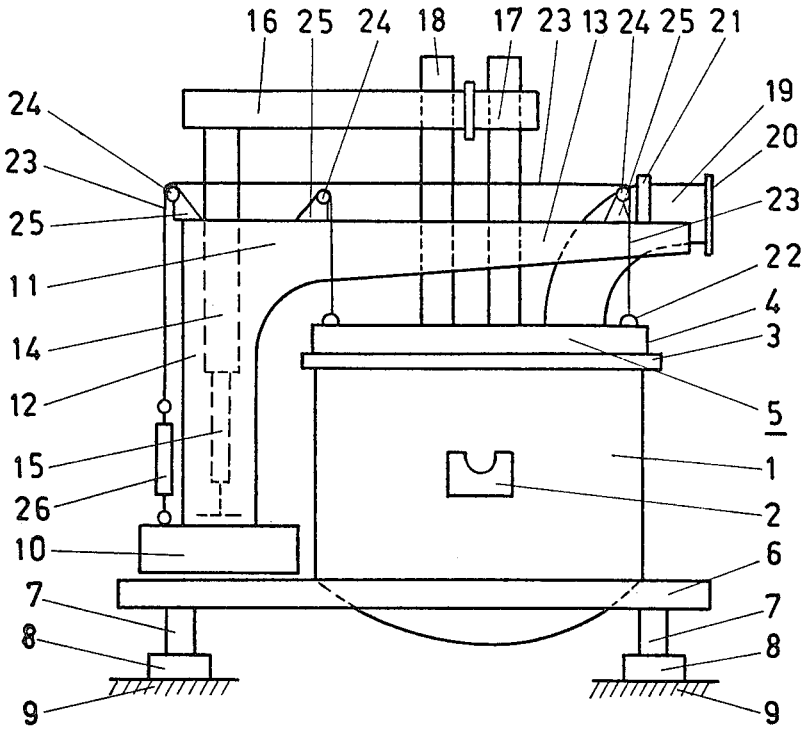
FIG. 1 is a schematic front view of an embodiment of an arc furnace including the furnace cover of the invention.

Referring now to the drawings, wherein like reference numerals dsignate identical or corresponding parts throughout the several views, and more particularly to FIG. 1 thereof, there is shown an arc furnace boiler 1 provided with flat furance cover 5 carried in an opening on a platform 6 which is supported on two hob cradles 7 supported on cradle beams 8 which are permanently anchored to foundation 9. FIG. 1 also shows pouring lip 2. Movable rotary pad 10 is located on platform 6, to which a pad cover raising and pivoting device 11 is fastened. Cover raising and pivoting device 11 consists of carrier arm 13 and carrier arm column 2.

Platform 6 also carries three electrode positioning columns 14, ony one of which is visible in FIG. 1. Electrode positioning columns 14 are connected to electrode positioning cylinders 15 so that they can be moved individually hydraulically in a vertical direction. Electrode carrier arms 16 are fastened to electrode positioning columns 14 and electrodes 18 are held in electrode holders 17 on their outer ends.

Only one of the three electrode carrier arms 16 is completely visible, and only two of the electrodes 18 can be seen, as the third is covered. Boiler gas removal piece 19 with flange 20 is located on furnace cover 5, the cover ring 4 of which rests on cover carrier ring 3 of furnace boiler 1.

Carrying lugs 22 are located on cover ring 4 of furnace cover 5, in which carrying cables 23 are fastened in the embodiment of FIG. 1, only two of which from a total of four are visible. Carrying cables 23 run over rollers 24 which are carried in roller carriers 25 on carrier arm 13. Carrying cables 23 are connected to hydraulic cylinder 26, which can raise and lower cover 5 from and onto boiler 1.

Figure 2:
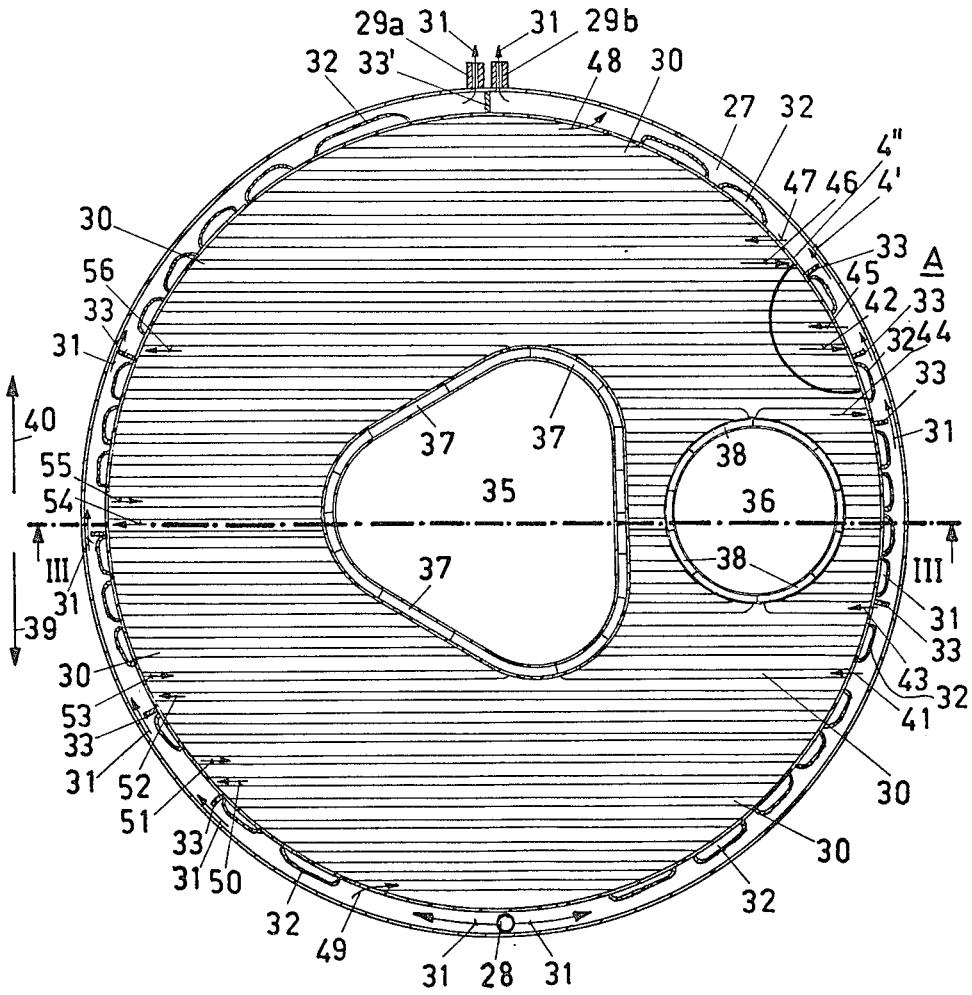
FIG. 2 is a schematic top view partially in cross-section, of a first embodiment of the furnace cover of the invention provided with a single layer of the cooling pipes.

In the embodiment shown in FIG. 2, the cover 4 includes plural cooling pipes 30 disposed in parallel and in a single layer.

All parallel cooling pipes 30, which are at a distance from each other, empty into cover ring 4 with outer jacket 4' and inner jacket 4''. This cover ring 4 is constructed as cooling liquid distributing conduit 27. For the sake of clarity, the fireproof construction material in which the cooling pipes are embedded is not shown in FIG. 2. Distributor conduit 27 is interrupted by end plate 33' and is divided into a left and a right distributing conduit cooling circulatory system. One cooling liquid entrance opening 28 is provided for both distributing conduit cooling circulatory system and for removing the cooling liquid short pipe 29*a* for the left distributing conduit cooling circulatory system and short pipe 29*b* for the right distributing conduit cooling circulatory system are provided on outer jacket 4' of cover ring 4. The direction of flow in both cooling circulatory systems in distributing conduit 27 is indicated by arrows 31. The liquid cooling device of furnace cover 5 includes several hydraulically separate cooling circulatory systems formed by several seriesconnected, parallel cooling conduit pairs, whereby dividing wall 33 is provided between the cooling conduit entrance openings and the cooling conduit exit openings of each cooling circulatory system. The cooling conduit entrance openings of all cooling circulatory systems are designated by arrows 41, 43, 45, 47, 49, 51, 53, 55 and the cooling conduit exit openings are designated by arrows 42, 44, 46, 48, 50, 52, 54, 56.

Bypass openings 34 are formed between dividing walls 33 and outer jacket 4' of cover ring 4, whereby, taking into consideration the hydraulic resistance of the associated cooling pipes 30, a predetermined amount of cooling liquid flows directlly through distributing conduit 27 and a predetermined amount of cooling liquid flows through cooling pipes 30. Part of cooling pipes 30 empty directly into distributing conduit 27 and another part of cooling pipes 30 are connected among each other inside distributing conduit 27 by deflection chambers 32 and hydraulically separated from distributing conduit 27.

Cover opening 35 for the electrodes is in the center of the cover and the opening for the boiler gas outlet 36 is in the right part. Cooling chambers 37 and 38, into which another part of cooling pipes 30 empty, are provided in the walls of openings 35 and 36. Arrow 39 indicates the tipping direction of the furnace during pouring, and arrow 40 the direction for removing the slag. This cooling arrangement assures that any vapor bubbles formed by the tipping process during pouring can be completely removed from the cooling system.

Figure 4:
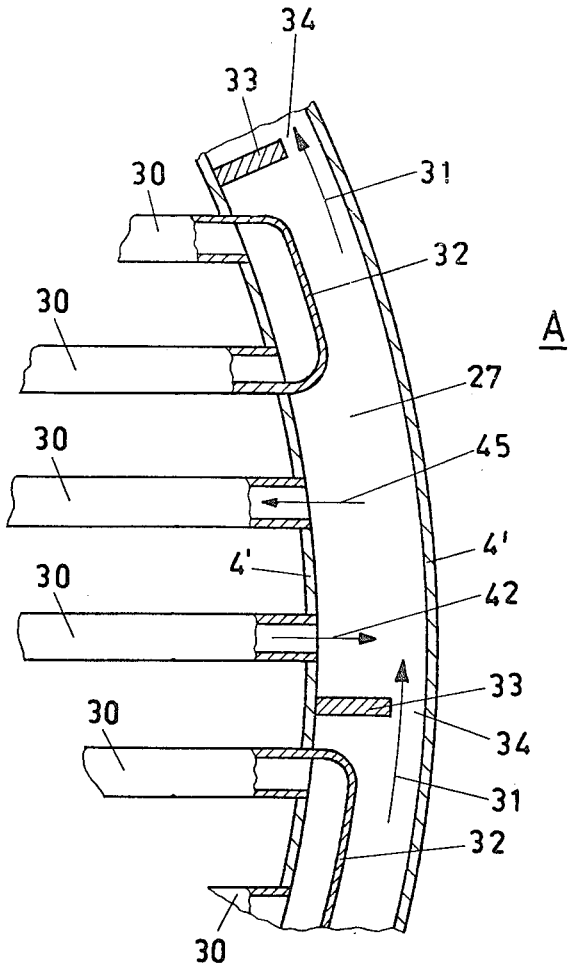
FIG. 4 is an enlarged horizontal cross-sectional view through a part of the furnace cover of FIG. 2.

FIG. 4 shows clearly the arrangement of the cooling circulatory systems. However, FIG. 2 is intended to make clear the flow path of the cooling liquid and the operation of the cooling system using a cooling circulatory system.

The cooling water enters through the cooling conduit entrance opening designated by arrow 41 into cooling pipe 30, passes into cooling chamber 37 of cover opening 35, exits from it, flows back through cooling pipe 30, is deflected by deflection chamber 32 and then enters into cooling chamber 38 of cover opening 36. The cooling liquid now circulates back and forth between cooling chambers 37 and 38, then flows only between cooling chambers 37 and deflection chambers 32 in distributing conduit 27 until it finally passes back through the exit opening designated by arrow 42 into distributing conduit 27. The cooling water is heated during its travel in cooling pipes 30 and cooling chambers 37 and 38 and now mixes with the relatively cooler liquid which flowed directly through distributing conduit 27 through bypass openings 34 which cools down the heated liquid. The process is repeated in every cooling circulatory system. This avoids overheating, and any vapor bubbles produced are removed without delay from the cooling system.

Figure 3:
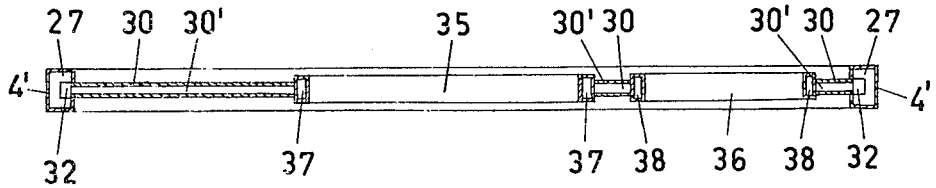
FIG. 3 is a vertical cross-sectional view through the furnace cover of FIG. 2.

In the vertical cross-sectional view shown in FIG. 3, deflection chambers 32 and cooling chambers 38 of cover opening 36 can be seen, which are connected to cooling conduits 30' of cooling pipes 30.

FIG. 4 shows an enlarged cutout of a part of furnace cover 5 of FIG. 2. The flow paths of the cooling liquid, which have already been shown in FIG. 2, can be seen more clearly. Dividing walls 33 according to the embodiment of FIGS. 2 and 4 could also be in another position than the one shown in FIGS. 2 and 4. However, it is significant for the effectiveness of the cooling system that dividing walls 33 and bypass openings 34 are located between the entrance and exit openings of cooling pipes 30 of each cooling circuit.

In FIG. 4 two cooling circulatory systems border on each other. From the one the heated water passes from cooling pipe 30 in the direction of arrow 42 into distributing conduit 27, is mixed there with the relatively cooler cooling liquid (arrow 31) which flowed through bypass opening 34. Then, the current of cooling liquid divides into two parts. The one part flows in the direction of arrow 45 into the adjacent cooling circulatory system through cooling pipe 30, while the other part flows further in distributing conduit 27 along deflection chamber 32 through upper bypass opening 34 shown in FIG. 4. This process just described is constantly repeated and assures an efficient cooling action in every cooling circulatory system of the furnace cover.

FIG. 5 shows a cutout of a schematic top view partially in cross-section, of a second embodiment of the furnace cover according to the invention provided with two layers of cooling pipes 30*a* and 30*b*. All cooling pipes 30*a*, 30*b*, which are parallel and positioned approximately vertically to the tipping direction and at a predetermined distance from each other, empty into cover ring 4 with outer jacket 4' and inner jacket 4'' constructed as the cooling liquid distributing conduit 27. In contrast to the cooling pipe arrangement of FIG. 2, cooling pipes 30*a*, 30*b* are in two layers in two planes. Cooling pipes 30*a* form an inner layer which faces the inside of the vessel, and are constructed in a single piece pipes 30*a* are U-shaped at their end opposite distributing conduit 27 and link up with the pipes 30*b* which form an outer layer of cooling pipes. Thus, cooling pipes 30*a*, 30*b* are constructed in pairs, whereby several cooling pipes 30*a*, 30*b* are series-connected in groups and are subdivided over the entire furnace cover 5 into several cooling circulatory systems as in FIG. 5.

The cooling circulatory system shown in FIG. 5 is more fully explained in the following description.

The cooling liquid enters centrally through entrance opening 28 into distributing conduit 27, flows to the left in the direction of arrow 31 and divides into two partial currents, one of which 31' flows through cooling conduit entrance opening 60 into lower cooling pipe 30*a* and the other of which flows through bypass opening 34 formed by dividing wall 33 and outer jacket 4' of cover ring 4. After the U-shaped deflection, the cooling liquid flows back through upper cooling pipe 30*b* toward distributing conduit 27, but is hydraulically separated from it by deflection chamber 32'. Deflection chamber 32' guides the cooling liquid to cooling liquid entrance opening 60' of the following lower cooling pipe 30*a* and the circulation repeats until the cooling liquid passes according to arrow 31' through exit opening 62 back into distributing conduit 27 and mixes there with partial current 31, which flows directly through distributing conduit 27, and cools off. Then, the cooling liquid flows in part through the next-following cooling circulatory system and in part directly through distributing conduit 27 in the manner described in more detail above.

The U-shaped ends of cooling pipes 30*a*, 30*b* projecting into furnace cover 5 are mechanically held fast by fastening traverses 62. Fastening traverses 62 are indicated only schematically in FIG. 5. Cooling conduit 37', the cooling liquid supply and removal of which is not shown in FIG. 5, is provided for cooling the wall of cover opening 35. The arrangement of cooling pipes 30*a*, 30*b* shown in FIG. 5 is given only as an example and for illustrating the two layers of cooling pipes 30*a*, 30*b*. Another embodiment would consist of arranging cooling pipes 30*a*, 30*b* over each other and not set off to the side as in FIG. 5. This would mean that the coiled continuation of cooling pipes 30*a*, 30*b* occurs exclusively through the U-shaped bend in a lateral direction and that distributing chamber 32' guides the cooling liquid vertically in the distributing conduit and not in a lateral direction as in FIG. 5.

FIG. 6 is a vertical cross-sectional view through furnace cover 5 according to FIG. 5, whereby lower layer 30*a* and upper layer 30*b* of the cooling pipes can be clearly recognized. Since cooling pipes 30*a*, 30*b* form the reinforcement for the fireproof construction material not shown in FIGS. 5 and 6, they must have sufficient mechanical rigidity to carry continuously the composite construction of cooling pipes and fireproof construction material in the level construction of furnace cover 5. This purpose is served by fastening traverses 62, which are supported on cover ring 4 and run at cover opening 35 along the outer wall of cooling conduit 37'. As they are not necessary for a direct understanding of the present invention, they are only indicated in FIGS. 5 and 6.

Figure 7:
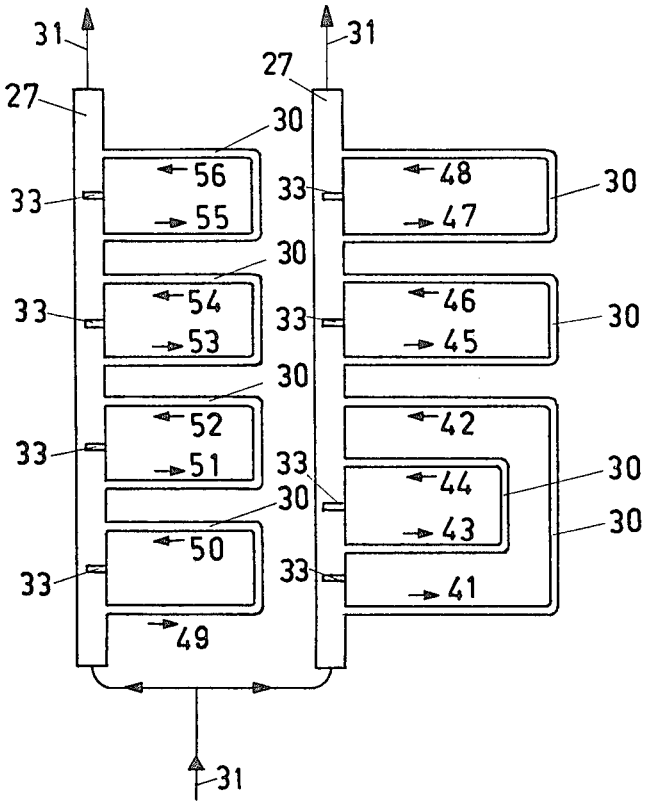
FIG. 7 is a schematic diagram of the cooling circuit arrangement.

FIG. 7 is a schematic diagram of the cooling circuit arrangement. As has already been described in detail for FIG. 2, distributing conduit 27 is divided into a right and a left part. Four cooling circulatory systems are connected to each part, to the left part the circulatory systems with entrance openings 41, 43, 45 and 47 and with exit openings 42, 44, 46 and 48, and to the right part the circulatory systems with entrance openings 49, 51, 53 and 55 and with exit openings 50, 52, 54 and 56, whereby bypass openings 34 are located between the entrance and the exit openings of each cooling circulatory system.

Figure 8:
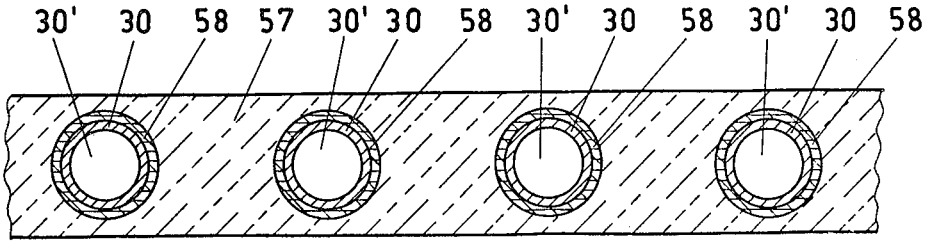
FIG. 8 is a vertical cross-sectional view through the cooling pipes and the fireproof construction material.

FIG. 8 is a vertical cross-sectional view through the cooling pipes and the fireproof construction material. Dilatation spaces 58 are provided between cooling pipes 30 and the surrounding construction material 57 which can be filled with silicon rubber, for example, in order to allow for the expansion of the fireproof mass and to avoid damage to cooling pipes 30. Silicon rubber is fireproof and compressible and acts as a buffer between cooling pipes 30 and fireproof construction material 57. In addition, it is possible that pressure forces from fireproof mass 57 act to a certain extent on the cooling pipes and deform them elastically. However, this deformation is reversible and has no disadvantageous effect on the service life of cooling pipes 30 or on the cooling action.

FIGS. 9 and 10 show further variations of the concept of the invention. Prefabricated construction units 57' of fireproof construction material 57 are positioned in varying arrangements around the cooling pipes, whereby the connection areas 59 of prefabricated construction units 57' are provided for mechanical fastening with a fireproof binding agent, e.g. silicon rubber.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A liquid cooled cover for an electric furnace having a tipping direction, comprising:

a cover member having a peripheral cover ring serving as a cooling liquid distributing conduit, said cover member at least partially constructed of a fireproof construction material; and cooling means disposed in said cover member for cooling said cover member, comprising, plural cooling pipes horizontally disposed in said cover member perpendicular to said tipping direction, said cooling pipes spaced at a predetermined distance from each other and embedded in said fireproof construction material thereby to reinforce said fire proof construction material, said cooling pipes connected by groups in series wherein respective groups have inlets and outlets in communication with said cooling liquid distributing conduit, and said cover member having at least one inlet and at least one outlet by which cooling liquid is exclusively supplied and removed to and from said cooling liquid distributing conduit.

2. A liquid cooled cover according to claim 1, comprising:

said cooling pipes arranged in at least two parts, one part emptying directly into the distributing conduit and the other part connecting adjacent conduits to each other inside said distributing conduit but hydraulically separated from said distributing conduit;

said cover member including at least one opening having peripheral walls, wherein the peripheral walls of said at least one opening include plural cooling chambers which are hydraulically separated from each other and which are in communication with selected of said cooling conduits;

wherein successive cooling conduit pairs connected to each other inside said distributing conduit communicate with successive of said cooling chambers of said at least one opening.

3. A liquid cooled cover according to claim 2, comprising:

said cooling conduits integrally connected in one piece in said distributing conduit.

4. A liquid cooled cover according to claim 2, comprising:

deflection means disposed in said distributing conduit for interconnecting pairs of said conduits hydraulically separated from said cooling liquid in said distributing conduit.

5. A liquid cooled cover according to claim 4, comprising:

at least a pair of said conduits interconnected by said deflection means communicating with respective of said successive cooling chambers in said at least one cover opening.

6. A liquid cooled cover according to claim 1, comprising:

plural hydraulically separated cooling circulatory systems, each formed by plural series-connected parallel cooling conduit pairs having inlet and outlet openings communicating with said distributing conduit, and said distributing conduit comprising at least one bypass opening disposed between inlet and outlet openings of each cooling circulatory system disposed in said cover member.

7. A liquid cooled cover according to claim 1, adapted to be mounted on a vessel of an electric furnace, comprising:

said cooling pipes arranged in two layers, including an inner layer adjacent said vessel and an outer layer disposed behind said inner layer relative to said vessel, the cooling pipes of said inner layer constructed in one piece and having one end of one part thereof communicating directly with said distributing conduit by means of respective inlet openings and having another part of the cooling pipes of said inner layer communicating with the cooling pipes of said outer layer, deflection means disposed in said distributing conduit such that the cooling pipes of said inner and outer layers communicate with each other hydraulically separated from cooling liquid outside said deflection means in said distributing conduit, the other end of said cooling pipes of said inner layer being U-shaped and communicating with the cooling pipes of said outer layer, the cooling pipes of said outer layer having one part communicating directly with said distributing conduit via respective outlets, and another part communicating with the cooling pipes of said inner layer via said deflection means.

8. A liquid cooled cover according to claim 2, wherein said deflection means are formed by chambers disposed in said distributing conduit for guiding cooling liquid from one cooling pipe to an adjacent cooling pipe of a cooling circulatory system hydraulically separated from cooling liquid in said distributing conduit.

9. A liquid cooled cover according to claim 7, wherein said deflection means are formed by chambers disposed in said distributing conduit for guiding cooling liquid from one cooling pipe to an adjacent cooling pipe of a cooling circulatory system hydraulically separated from cooling liquid in said distributing conduit.

10. A liquid cooled cover according to claim 1, wherein each cooling pipe has a predetermined outer diameter, and wherein the spacing between oppositely adjacent cooling pipes is approximately twice as great as the diameters thereof.

11. A liquid cooled cover according to claim 2, wherein each cooling pipe has a predetermined outer diameter, and wherein the spacing between oppositely adjacent cooling pipes is approximately twice as great as the diameters thereof.

12. A liquid cooled cover according to claim 6, wherein each cooling pipe has a predetermined outer diameter, and wherein the spacing between oppositely adjacent cooling pipes is approximately twice as great as the diameters thereof.

13. A liquid cooled cover according to claim 7, wherein each cooling pipe has a predetermined outer diameter, and wherein the spacing between oppositely adjacent cooling pipes is approximately twice as great as the diameters thereof.

14. A liquid cooled cover according to claim 1, wherein said fireproof construction material is formed as at least one prefabricated construction unit.

15. A liquid cooled cover according to claim 15, wherein said fireproof construction material is formed as plural prefabricated construction units permanently connected to each other mechanically by means of a fire proof binding agent.

16. A liquid cooled cover according to claim 15, wherein said fireproof binding agent comprises: silicon rubber.

17. A liquid cooled cover according to claim 1, wherein said cooling pipes are sized relative to said fireproof construction material to provide dilatation spaces between said cooling pipes and said surrounding fireproof construction material.

18. A liquid cooling cover according to claim 17, comprising:

a fireproof compressible material disposed in said dilatation spaces.

19. A liquid cooled cover according to claim 19, wherein said fireproof compressible material comprises: silicon rubber.

20. A liquid cooled cover according to claim 6, wherein the at least one bypass opening provided in said distributing conduit is dimensioned so that taking into consideration the hydraulic resistance of said cooling conduits, a predetermined amount of cooling liquid flows through the at least one bypass opening which is at smaller than the amount of cooling liquid flowing through said cooling conduits.

21. A liquid cooled cover according to claim 6, wherein the at least one bypass opening provided in said distributing conduit is dimensioned so that taking into consideration the hydraulic resistance of said cooling conduits, a predetermined amount of cooling liquid flows through the at least one bypass opening which is at least as great as the amount of cooling liquid flowing through said cooling conduits.

* * * * *